United States Patent [19]

Kukes et al.

[11] Patent Number: 4,522,702

[45] Date of Patent: Jun. 11, 1985

[54] DEMETALLIZATION OF HEAVY OILS WITH PHOSPHOROUS ACID

[75] Inventors: Simon G. Kukes; David R. Battiste, both of Bartlesville, Okla.

[73] Assignee: Phillips Petroleum Company, Bartlesville, Okla.

[21] Appl. No.: 655,113

[22] Filed: Sep. 27, 1984

[51] Int. Cl.[3] ..... C10G 45/00; C10G 17/00

[52] U.S. Cl. ..... 208/89; 208/211; 208/252

[58] Field of Search ..... 208/252, 89, 211

[56] References Cited

U.S. PATENT DOCUMENTS

| | | | |
|---|---|---|---|
| 2,682,496 | 6/1954 | Richardson et al. | 196/50 |
| 2,919,245 | 12/1959 | Wolfe | 208/252 |
| 3,165,462 | 1/1965 | Friedman et al. | 208/86 |
| 3,575,844 | 4/1971 | Schutt | 208/89 |
| 3,622,505 | 11/1971 | Tilley et al. | 208/252 |
| 4,159,940 | 7/1979 | Smith | 208/254 H |
| 4,192,736 | 3/1980 | Kluksdahl | 208/251 H |
| 4,411,774 | 10/1983 | Johnson | 208/252 |

FOREIGN PATENT DOCUMENTS

| | | | |
|---|---|---|---|
| 550713 | 12/1957 | Canada | 208/252 |

*Primary Examiner*—D. E. Gantz
*Assistant Examiner*—Helane Myers
*Attorney, Agent, or Firm*—French and Doescher

[57] ABSTRACT

An improved process for removing metals from heavy oils and other hydrocarbon feed streams is disclosed. The process includes adding phosphorous acid to the hydrocarbon feed stream under suitable demetallizing conditions. It is believed that phosphorous acid reacts with the metals contained in the hydrocarbon containing feed stream to form oil-insoluble compounds that can be removed from the hydrocarbon containing feed stream by any conventional method, such as filtration, centrifugation, or settling/decantation.

24 Claims, No Drawings

DEMETALLIZATION OF HEAVY OILS WITH PHOSPHOROUS ACID

BACKGROUND OF THE INVENTION

This invention relates to an improved process for removing metals from heavy oils and other hydrocarbon feed streams.

It is well known that heavy crude oils, as well as products from extraction and/or liquefaction of coal and lignite, products from tar sands, products from shale oil and similar products may contain metals such as vanadium and nickel. The presence of the metals makes further processing of heavier fractions difficult since the metals generally act as poisons for catalysts employed in processes such as catalytic cracking, hydrogenation or hydrodesulfurization.

SUMMARY OF THE INVENTION

It is thus an object of this invention to provide a process for at least partially removing metals from a hydrocarbon containing feed stream so as to improve the processability of such hydrocarbon containing feed stream and especially improve the processability of heavy crude oils, such as Monagas heavy crude.

In accordance with the present invention, phosphorous acid is mixed with a hydrocarbon containing feed stream, which contains metals, under suitable demetallization conditions. It is believed that the phosphorous acid reacts with metals contained in the hydrocarbon containing feed stream to form compounds that are substantially insoluble in said hydrocarbon feed stream and that can be removed from the hydrocarbon containing feed stream by any conventional method such as filtration, centrifugation or settling/decantation. Removal of the metals from the hydrocarbon containing feed stream in this manner provides for improved processability of the hydrocarbon containing feed stream in processes such as catalytic cracking, hydrogenation and hydrodesulfurization. Phosphorous acid is a more effective demetallizing agent (especially in terms of the removal of vanadium) than phosphoric acid.

Other objects and advantages of the invention will be apparent from the foregoing brief description of the invention and the appended claims as well as the detailed description of the invention which follows.

DETAILED DESCRIPTION OF THE INVENTION

Any metal which will react with phosphorous acid to form a substantially oil-insoluble compound can be removed from a hydrocarbon feed stream in accordance with the present invention. The present invention is particularly applicable to the removal of vanadium and nickel, most particularly to the removal of vanadium.

Metals can be removed from any suitable hydrocarbon containing feed streams. Suitable hydrocarbon containing feed streams include petroleum products, coal pyrolyzates, products from extraction and/or liquefaction of coal and lignite, products from tar sands, products from shale oil and similar products. Suitable hydrocarbon feed streams include gas oil having a boiling range from about 205° C. to about 538° C. and residuum. However, the present invention is particularly directed to heavy feed streams such as heavy crude oils and other materials which are generally regarded as being too heavy to be distilled. These materials will generally contain the highest concentrations of metals such as vanadium and nickel. Typically the feedstocks employed will consist primarily of hydrocarbons and will contain about 10 to 1000 ppm of vanadium and about 5 to about 500 ppn of nickel. In addition, these heavy feedstocks also contain sulfur and nitrogen impurities and coke precursors.

The process of this invention can be carried out by means of any apparatus whereby there is achieved a mixing of the phosphorous acid with the hydrocarbon containing feed stream. The process is in no way limited to the use of a particular apparatus. The processs can be carried out as a continuous process or as a batch process. The term hydrocarbon containing feed stream is used herein to refer to both a continuous and batch process.

The phosphorous acid demetallizing agent employed in this invention can be substantially anhydrous orthophosphorous acid ($H_3PO_3$) or diphosphorous acid ($H_4P_2O_5$), preferably $H_3PO_3$. Also relatively concentrated aqueous solutions of $H_3PO_3$ (e.g., containing about 40–80 weight-% of the acid) can be employed. It is also within the scope of this invention to employ concentrated (at least 50 weight-%) acidified aqueous solutions of ammonium or alkali metal salts of phosphorous acids, such as $NaH(HPO_3)$ or $Na_2(HPO_3)$. Furthermore, it is also within the scope of this invention to generate $H_3PO_3$ in-situ by reaction of $P_2O_3$ with water or by hydrolysis of phosphorous trihalides, e.g., $PCl_3$, or esters such as $P(OR)_3$ and $OPH(OR)_2$, wherein each R can be an alkyl, cycloalkylaryl or aralkyl radical and wherein each R preferably has 1 to 20 carbon atoms. The presently preferred demetallizing agent of this invention is substantially anhydrous $H_3PO_3$.

Any suitable amount of phosphorous acid can be employed. The maximum amount of phosphorous acid employed in the process of this invention is primarily determined by economic factors such as material and equipment costs. The weight ratio of phosphorous acid to hydrocarbon stream ranges generally from about 1:500 to about 1:5, preferably from about 1:200 to about 1:10, most preferably from about 1:100 to about 1:25.

Any suitable reaction time between phosphorous acid and the hydrocarbon containing feed stream can be utilized. In general, the reaction time can range from a minimal time necessary to substantially demetallize the hydrocarbon containing feed stream, to a maximum economically feasible time to remove at least a portion of the metals from the hydrocarbon containing feed stream. Preferably, the reaction time will range from about 1 minute to about 10 hours, more preferably from about 0.5 to about 2 hours. Thus, for a continuous process, the flow rate of the hydrocarbon feed stream mixed with phosphorous should be such that the time required for the passage of the mixture through the reactor (residence time) will preferably be in the range of about 1 minute to about 10 hours more preferably from about 0.5 to about 2 hours. For a batch process, the mixture should simply remain in the reactor under reaction conditions for a time preferably in the range of about 1 minute to about 10 hours, more preferably from about 0.5 to about 2 hours (again generally referred to as residence time).

The demetallization process of the present invention can be carried out at any suitable temperature. The temperature will generally range from a minimal demetallizing temperature to any economically practical temperature. Preferably, the temperature will be in the range of about 200° C. to about 500° C., most preferably about 350° C. to about 450° C. Higher temperatures do improve the removal of metals but temperatures should not be utilized which will have adverse effects on the hydrocarbon containing feed stream. Lower temperatures can generally be used for lighter feeds.

A gas can also be present during the mixing of the hydrocarbon containing feed stream and phosphorous acid. The gas allows high pressure operation to be achieved. Gases such as hydrogen, air, inert gases (e.g. nitrogen), methane and carbon dioxide can be utilized.

Any suitable pressure can be utilized in the demetallization process. When a non-oxygen containing gas is utilized, the reaction pressure can range from about atmospheric to any economically practical high pressure such as 3000 psig. When hydrogen gas is utilized, the pressure will preferably be in the range of about 100 to about 1000 psig. Higher $H_2$ pressures tend to reduce coke formation but operations at high pressure can have adverse economic consequences.

The hydrocarbon containing feed stream and the phosphorous acid demetallizing agent can be mixed in any suitable manner. In a continuous operation, it is preferred to premix the hydrocarbon feed stream with the demetallizing agent, e.g., in a vessel equipped with a mechanical stirrer, or in a static mixer, or by means of a recirculating pump. In a batch operation, the above-cited mixing means can also be employed so as to provide a mixture of hydrocarbon feed and demetallizing agent, or the hydrocarbon feed stream and the demetallizing agent can be added to the reactor simultaneously or sequentially and thoroughly mixed before and/or during heating of the reactor contents.

It is believed that phosphorous acid reacts with metals contained in the hydrocarbon feed stream, particularly heavy oil to form substances that are substantially insoluble in said hydrocarbon feed. These substantially oil-insoluble substances can be removed from the treated hydrocarbon containing feed stream by any suitable method. Filtration is presently preferred, but other methods such as centrifugation, or settling of insoluble substances and subsequent decanting of the clarified hydrocarbon stream can be utilized if desired.

If the demetalization process of the present invention is used in a refinery where hydrodesulfurization is practiced, the demetallization process of this invention can be employed before or after a hydrodesulfurization step. The fact that the feedstream has been passed through a hydrodesulfurization process does not affect the demetallization process of the present invention. It is, however, preferred to carry out the demetallization of this invention first and thereafter desulfurize at least a portion of the products, preferably by a catalytic hydrotreating process, which generally removes more metals, sulfur, nitrogen and carbon precursors. Generally, at least a portion of the thus hydrotreated product stream is subsequently cracked, e.g. in a fluidized catalytic cracking unit, so as to produce gasoline and other useful fuels. If, however, the sulfur content of the hydrocarbon feed is low, the desulfurization step can be omitted and the substantially demetallized hydrocarbon stream can be fed directly to a cracking reactor.

The following example is presented to further illustrate the invention, without unduly limiting the scope of this invention.

EXAMPLE I

The demetallization of a Monagas (Venezuela) pipeline oil was carried out as a batch process in a stirred, stainless steel autoclave reactor. Monagas pipeline oil is a Monogas heavy crude that is diluted with a few percent of a fuel oil to reduce its viscosity so that it can be transported in pipelines. The pipeline oil feed for runs 1–6 contained about 335 parts per million (ppm) vanadium and about 98 parts per million (ppm) of nickel, and the feed for runs 7 and 8 contained about 341 ppm V and 104 ppm Ni.

The stirred autoclave was charged with about 110 grams of pipeline oil and variable amounts of phosphorous compounds as demetallizing agent. The sealed autoclave, at atmospheric pressure was heated to a specified temperature during a time period of about 1 hour and then held at that temperature for about 1 hour, while the reactor content was stirred at a rate of about 1000 rpm.

After cooling, the mixture in the autoclave was filtered through a fritted glass filter and analyzed for nickel and vanadium by atomic absorption spectrometry and plasma emission spectrometry, respectively. Process conditions and results are summarized in Table I. In all runs the gas above the reaction mixture in the autoclave was air.

TABLE I

| Run | Demetal Agent | Weight-%[1] of Agent | Temp. (°F.) | PPM in Product V | PPM in Product Ni | PPM in Product V + Ni | %-Removal of V | %-Removal of (V + Ni) |
|---|---|---|---|---|---|---|---|---|
| 1 (Invention) | $H_3PO_3$[2] | 1.1 | 754 | 93 | 127[4] | 220[5] | 72 | 49[5] |
| 2 (control) | $H_3PO_4$[3] | 1.2 | 754 | 134 | 94 | 228 | 60 | 47 |
| 3 (Invention) | $H_3PO_3$ | 2.0 | 753 | 100 | 70 | 170 | 70 | 61 |
| 4 (Control) | $H_3PO_4$ | 2.1 | 753 | 169 | 103[4] | 272[6] | 50 | 37[6] |
| 5 (Invention) | $H_3PO_3$ | 3.8 | 754 | 150 | 41 | 191 | 55 | 56 |
| 6 (Control) | $H_3PO_4$ | 3.8 | 754 | 196 | 75 | 271 | 41 | 37 |
| 7 (Invention) | $H_3PO_3$ | 1.3 | 783 | 5 | 33 | 38 | 99 | 91 |
| 8 | None | 0 | 783 | 104 | 30 | 134 | 70 | 70 |

TABLE I-continued

| Run | Demetal Agent | Weight-%[1] of Agent | Temp. (°F.) | PPM in Product V | Ni | V + Ni | %-Removal of V | (V + Ni) |
|---|---|---|---|---|---|---|---|---|
| (Control) | | | | | | | | |

[1]based on the entire mixture of oil and acid
[2]employed as substantially anhydrous $H_3PO_3$
[3]applied as an aqueous solution of 85 wt-% $H_3PO_4$
[4]probably an erroneous data print since feed contained less Ni
[5]assuming that no Ni at all was removed, ppm of (V + Ni) would be 191, and %-removal of (Ni + V) would be 56
[6]assuming that no Ni at all was removed, ppm of (V + Ni) would be 267, and %-removal of (Ni + V) would be 38.

Data in Table I show that the demetallizing agent of this invention, phosphorous acid ($H_3PO_3$), was unexpectedly more effective in removing nickel and vanadium, particularly vanadium, from a heavy oil than a known demetallizing agent, $H_3PO_4$ (phosphoric acid) (see runs 1–6). Especially in the range of about 2–4 weight-% acid, $H_3PO_3$ was far superior to $H_3PO_4$ in the removal of vanadium and nickel. A comparison of 7 with run 2 indicates that the removal of nickel and vanadium was more effective at a higher temperature.

Reasonable variations and modifications are possible within the scope of the disclosure and the appended claims.

We claim:

1. A process for treating a feed stream which contains hydrocarbons and metals comprising contacting said feed stream under suitable conditions with an amount of phosphorous acid sufficient to convert at least a portion of said metals to compounds which are substantially insoluble in said hydrocarbon feed stream.

2. A process as defined in claim 1 wherein said hydrocarbon feed stream is selected from the group consisting of crude oil, topped crude, residuum, coal extract, coal pyrolyzate and shale oil.

3. A process as defined in claim 1 wherein said metals are selected from at least one of vanadium and nickel.

4. A process as defined in claim 1 wherein the weight ratio of phosphorous acid to the hydrocarbon feed stream is in the range of about 1:500 to about 1:5.

5. A process as defined in claim 4, wherein phosphorous acid is substantially anhydrous $H_3PO_3$.

6. A process for removing metals contained in a hydrocarbon feed stream comprises (a) contacting said feed stream with phosphorous acid at a phosphorous acid to hydrocarbon feed weight ratio ranging from about 1:500 to about 1:5, at a temperature ranging from about 200° C. to about 500° C., for a time ranging from about 1 minute to about 10 hours, so as to convert at least a portion of said metals to compounds which are substantially insoluble in said feed stream; and (b) removing said substantially insoluble compounds from said hydrocarbon feed stream.

7. A process as defined in claim 6 wherein said hydrocarbon feed stream is selected from the group consisting of crude oil, topped crude, residuum, coal extract, coal pyrolyzate and shale oil.

8. A process as defined in claim 6 wherein said metals are selected from at least one of vanadium and nickel.

9. A process as defined in claim 6 wherein the weight ratio of phosphorous acid to hydrocarbon feed stream ranges from about 1:200 to about 1:10.

10. A process as defined in claim 9 wherein said hydrocarbon feed stream is selected from the group consisting of crude oil, topped crude, residuum, heavy oil extract coal pyrolyzate and shale oil.

11. A process as defined in claim 10 wherein said metals are selected from vanadium and nickel.

12. A process as defined in claim 11 wherein the weight ratio of phosphorous acid to hydrocarbon feed stream ranges from about 1:100 to about 1:25.

13. A process as defined in claim 12 wherein the temperature ranges from about 350° C. to about 450° C.

14. A process for purifying a hydrocarbon feed stream containing metals, sulfur and nitrogen impurities and coke precursors, comprising the steps of:

(a) contacting said hydrocarbon stream under suitable reaction conditions with an amount of phosphorous acid sufficient to convert at least a portion of said metals to compounds which are substantially insoluble in said hydrocarbon feed stream;

(b) separating said substantially insoluble metal compounds from the hydrocarbon feed stream treated by step (a);

(c) hydrotreating at least a portion of the hydrocarbon stream, from which said substantially insoluble metal compounds have been removed by step (b), so as to remove sulfur impurities.

15. A process as defined in claim 14 comprising the additional step of (d) feeding at least a portion of the hydrocarbon stream, which has been hydrotreated in step (c), to a cracking operation.

16. A process as defined in claim 14 wherein the weight ratio of phosphorous acid to hydrocarbon feed ranges from about 1:500 to about 1:5. and said contacting is carried out at a temperature ranging from about 200° C. to about 500° C.

17. A process as defined in claim 14 wherein the hydrocarbon feed stream is selected from the group consisting of crude oil, topped crude, residuum, heavy oil extract, coal pyrolyzate and shale oil.

18. A process as defined in claim 15 wherein the hydrocarbon feed stream is selected from the group consisting of crude oil, topped crude, residuum, coal extract, coal pyrolyzate and shale oil.

19. A process as defined in claim 4 wherein said metals are selected from at least one vanadium and nickel.

20. A process as defined in claim 14 wherein said separating step is filtration.

21. A process as defined in claim 14 wherein said separating step is centrifugation.

22. A process as defined in claim 14 wherein said separating step is settling of insoluble substances and subsequent decanting of the clarified hydrocarbon stream.

23. A process as defined in claim 6 comprising the additional step of feeding at least a portion of the hydrocarbon stream, from which said substantially insoluble metal compounds have been removed by step (b), to a cracking operation.

24. A process as defined in claim 4 wherein phosphorous acid is an aqueous solution containing about 40–80 weight-% $H_3PO_3$.

* * * * *

UNITED STATES PATENT AND TRADEMARK OFFICE

CERTIFICATE OF CORRECTION

PATENT NO. : 4,522,702

DATED : 6/11/85

INVENTOR(S) : Simon G. Kukes et. al.

It is certified that error appears in the above-identified patent and that said Letters Patent are hereby corrected as shown below:

19. A process as defined in claim 14 wherein said metals are selected from at least one vanadium and nickel.

Signed and Sealed this

*Twenty-eighth* Day of *January 1986*

[SEAL]

*Attest:*

DONALD J. QUIGG

*Attesting Officer*

*Commissioner of Patents and Trademarks*